US007536789B2

(12) United States Patent
Michel

(10) Patent No.: US 7,536,789 B2
(45) Date of Patent: May 26, 2009

(54) DUMMY HAIR CLIPPER HEAD FOR THE ATTACHMENT OF GUIDE COMBS

(76) Inventor: Matthew Justin Michel, 123 1/2 S. Ave. 63, Los Angeles, CA (US) 90042

( * ) Notice: Subject to any disclaimer, the term of this patent is extended or adjusted under 35 U.S.C. 154(b) by 63 days.

(21) Appl. No.: 11/470,256

(22) Filed: Sep. 6, 2006

(65) Prior Publication Data

US 2008/0072437 A1 Mar. 27, 2008

(51) Int. Cl.
*B26B 19/00* (2006.01)

(52) U.S. Cl. ..... 30/200; 30/233.5

(58) Field of Classification Search ..... 30/195, 30/200, 201, 233, 233.5, 194
See application file for complete search history.

(56) References Cited

U.S. PATENT DOCUMENTS

| | | | |
|---|---|---|---|
| 84,860 | A | 12/1868 | Craig |
| 1,004,404 | A | 9/1911 | Fordyce |
| 1,558,729 | A | 10/1925 | Wahl |
| 1,878,345 | A | 9/1932 | Suter |
| 1,957,430 | A | 5/1934 | Adelmo |
| 2,108,184 | A | 2/1938 | Wellenius |
| 2,780,829 | A | 2/1957 | Cohen |
| 3,308,500 | A | 3/1967 | Woodruff |
| 3,520,311 | A | 7/1970 | Lesersek |
| 3,626,546 | A | 12/1971 | Dove |
| 3,668,736 | A | 6/1972 | Loscalzo |
| 3,696,818 | A | 10/1972 | Weber |
| 3,937,231 | A | 2/1976 | Tucker |
| D244,712 | S | 6/1977 | Houston |
| 4,538,362 | A | 9/1985 | Andis |
| 4,813,439 | A | 3/1989 | Morgan |
| 5,095,853 | A | 3/1992 | Kruger |
| 5,195,245 | A | 3/1993 | Malone |
| 5,649,502 | A | 7/1997 | Frank |
| 5,768,748 | A | 6/1998 | Silvera |
| 5,937,526 | A | 8/1999 | Wahl |
| 6,079,107 | A | 6/2000 | Horvath |
| 6,302,607 | B1 | 10/2001 | Burrowes |
| 6,775,922 | B2 | 8/2004 | Langley |
| 6,807,736 | B2 | 10/2004 | Langley |

*Primary Examiner*—Kenneth E Peterson
*Assistant Examiner*—Phong Nguyen

(57) ABSTRACT

A dummy hair clipper head which conforms to those dimensions of the head of a hair clipper (its stationary blade) which are necessary for its compatibility with attachment guide combs. This dummy hair clipper head provides a base onto which the attachment guide combs can be attached, and by which they can be held, allowing them to be organized within a kit among other uses. The dummy hair clipper head can be connected to a tool to allow the combs to be used with that tool, such as a pair of scissors to create a scissor comb, or including a conduit through the dummy hair clipper head to be used as a vacuum comb, a dryer comb, and a liquid dispensing comb.

15 Claims, 7 Drawing Sheets

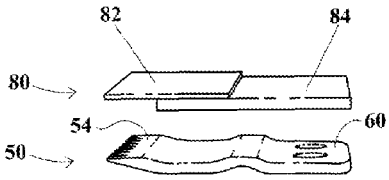
FIG 18
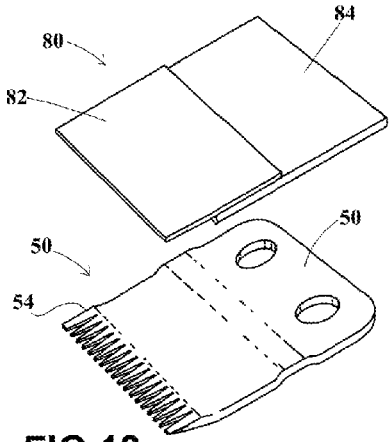
FIG 19
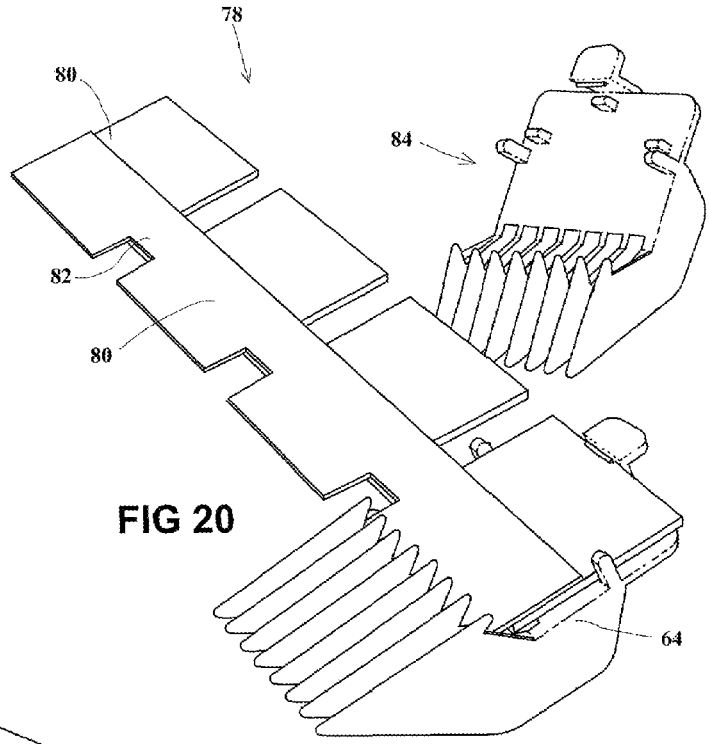
FIG 20
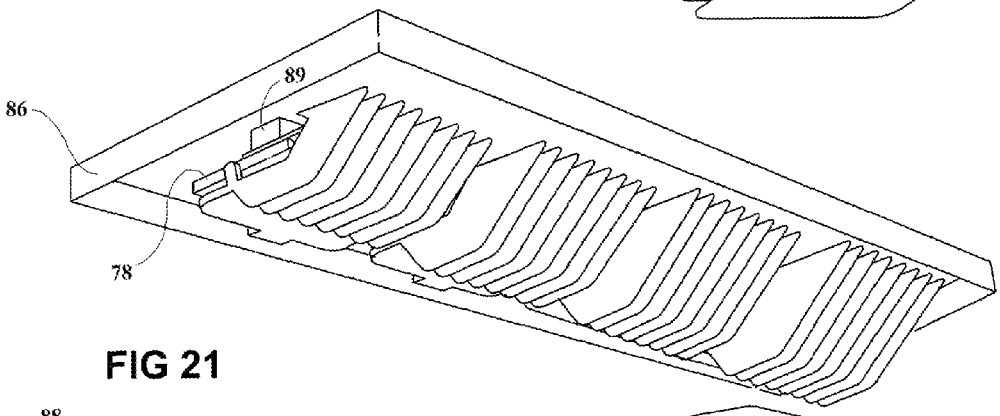
FIG 21
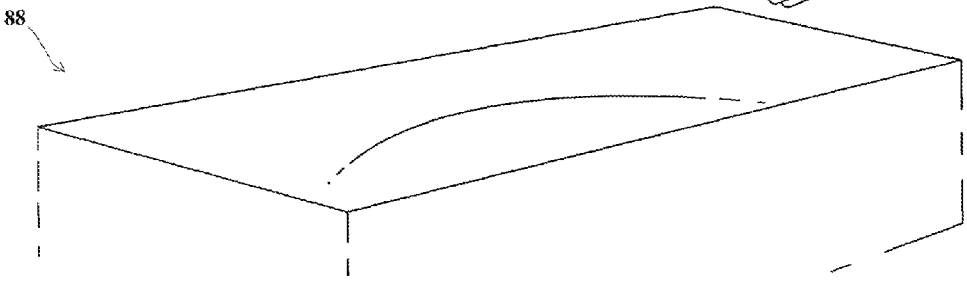

DUMMY HAIR CLIPPER HEAD FOR THE ATTACHMENT OF GUIDE COMBS

FIELD OF THE INVENTION

The present invention relates to alternative means of compatibility with the attachment guide combs intended for electric hair clippers and their attachment to other objects including an attachment guide comb organizer, a scissor comb, a razor comb, a vacuum comb, a dryer comb, and a liquid dispensing comb.

BACKGROUND OF THE INVENTION

Before giving the background of the embodiments of the present invention it is first important to understand the background of the electric hair clipper and its attachment guide combs which are as follows.

The hair clipper kit found in most homes today includes an electric hair clipper and a set of four to ten attachment guide combs of different lengths, all stored loose in a box. A typical example of the hair clipper kit is shown in the 2004 Langley U.S. Pat. No. 6,807,736. FIG. 4 shows a typical hair clipper with attachment guide comb attached and FIGS. 10-17 show an attachment guide comb from all angles.

The hair clipper has changed little since the 1925 WAHL U.S. Pat. No. 1,558,729. It has a moving blade that reciprocates against a stationary blade. The stationary blade is rectangular with protruding edges. The accessory attachment guide combs snap onto the stationary blade, secured at its edges, and allow the operator to cut hair to a chosen length.

The stationary blade has a design ideally suited to its function. The attachment guide combs have been subsequently designed to be compatible with these dimensions. The present design beginning with the 1934 Adelmo U.S. Pat. No. 1,957,430 and was more recently taught in the 1999 Wahl U.S. Pat. No. 5,937,526.

An essential grooming tool, there are a wide variety of hair clipper kits and attachment guide combs available today. Across most makes and models the stationary blade of the hair clipper maintains the same dimensions, allowing the attachment guide combs to be interchangeable.

The attachment guide comb has five principal advantages over the standard flat comb: selectable length, easy attachment, stable support, lifting teeth and an unobstructed path for hair.

Selection of the length of hair cut by attaching the appropriate attachment guide comb has made it possible for unskilled operators to use an electric hair clipper to achieve a hair cut of uniform length. Once in place the attachment guide comb makes it impossible for the blade to get closer to the scalp than the length of the attachment guide comb teeth will allow. Easy attachment to the head of the hair clipper allows an unskilled operator to quickly attach attachment guide combs. Only one hand is required once the attachment guide comb is attached.

The stable support provided by the attached guide comb means that the clipper will not rock or wobble in any direction when resting on the scalp. The attachment guide comb is designed with teeth that form a rectangular base of support as wide as the hair clipper and with a length typically between ½ inch up to a few inches depending on the size of the attachment guide comb.

The teeth of the attachment guide comb lift the hair to the blade. The teeth of the attachment guide comb are very different from the teeth of a standard flat comb. The teeth of the standard flat comb are rods while the attachment guide comb's teeth are flat walls which rise from the scalp all the way up to the cutting blade. The attachment guide comb is pushed through the hair which is gathered into the comb. The strands of hair are then supported by these vertical teeth as the hair is cut.

Finally, with an attachment guide comb the path for the uncut hair beneath the clipper blade is unobstructed. This means that hair can be gathered into the comb and pass through it without encountering obstructions. This allows the attachment guide comb to be pulled smoothly through the hair. This unobstructed path is made possible by the position of the back of the attachment guide comb, to which all the teeth are attached. The back of the comb is positioned above and behind the blade of the clipper and does not come into contact with the hair.

There is one problem with the means by which the attachment guide combs attach to the stationary blade of the hair clipper. It is that the leading edge of the clipper, which consists of a series of small teeth, must support the larger teeth of the attachment guide comb. This requires the attachment guide comb teeth to be positioned so as to line up with the ends of the stationary blades teeth. Unfortunately the attachment guide comb's teeth, being flexible, can slip off the supporting small metal teeth of the guide comb, losing its support and bending to one side.

The embodiments described in the present invention include five tools which employ a comb: the scissor comb, the razor comb, the vacuum comb, the dryer comb, and the liquid dispensing comb. The background of each of these tools is as follows.

The attachment of a comb to a pair of scissors has been developed for two reasons: to prevent the scissors from cutting skin and to regulate the length of hair cut.

The 1993 Malone U.S. Pat. No. 5,195,245 teaches safety scissors with a comb adjacent to the blade edge. This scissor comb effectively prevents anything that cannot fit between the comb teeth from reaching the blade. This design was not intended to regulate the length of hair cut and lacks this advantage.

Designed to regulate the length of hair cut, the 1868 Craig U.S. Pat. No. 84,860 taught a comb which attached to a pair of scissors, the distance between the two being adjustable by a sliding support. The 1911 Fordyce U.S. Pat. No. 1,004,404 taught a clip on comb attachment that could be quickly detached by a spring clip. The 2000 Horvath U.S. Pat. No. 6,079,107 teaches a pair of scissors with a comb contemplated for use in trimming facial hair. All three designs have comb backs at surface level obstructing the path for the uncut hair and would therefore not pull smoothly through the hair.

The attachment of a comb to a razor blade for the purpose of cutting hair has the advantages of being economical, simple to use, and silent (an advantage in pet grooming). Examples include the 1908 Owens U.S. Pat. No. 892,679, which taught a comb designed to be clipped on to a straight razor, and the 1909 Becker U.S. Pat. No. 919,307, which taught a holder that held a common safety razor against a common comb. The 1987 Custer U.S. Pat. No. 4,663,841 taught an economical safety razor holder with a sliding comb member which permitted limited adjustment of the comb length. The Custer design has both a narrow support base and a comb back at surface level and would therefore not work well being pulled through the hair.

The attachment of a comb to a vacuum source to clean the hair has the advantage of dislodging more material by agitating the hair. It is important that the length of the comb's teeth correspond to the thickness of the hair. If the teeth are too short they will only partially penetrate the hair. If the teeth are too long the vacuum will lose suction through the gap between the surface of the hair and the vacuum inlet.

Many vacuum combs have addressed cleaning a single length of hair. The 1932 Suter U.S. Pat. No. 1,878,345 and the 1957 Cohen U.S. Pat. No. 2,780,829 both teach short toothed vacuum attachments intended for use on the short haired coats of horses. The 1992 Kruger U.S. Pat. No. 5,095,853 and the 1998 Silvera U.S. Pat. No. 5,768,748 both teach vacuum attachments with long toothed combs suitable for use on the coat length of some dogs and cats.

Several devices have addressed the need for combing through hair of different thickness. The 1967 Woodruff U.S. Pat. No. 3,308,500 taught an attachment with a fixed short comb in combination with a long comb which could be rotated into place. The 1971 Dove U.S. Pat. No. 3,626,546 taught a comb with adjustable length, a lever moving the teeth in and out of the housing. The 1972 Loscalzo U.S. Pat. No. 3,668,736 taught a vacuum comb with a plurality of different comb lengths, which could be snapped into position, while also addressing the narrow support base that the comb provides by adding a depth stop to the rear of the attachment, which could be changed with the comb. Though limited and complex, these designs would be effective on different hair thickness.

The attachment of a comb to a hair dryer has the advantage of improving the circulation of air through the hair. For example the 1972 Weber U.S. Pat. No. 3,696,818 teaches a hollow comb attached to a hair dryer by a flexible tube. The 1976 Tucker U.S. Pat. No. 3,937,231 teaches a comb attached directly to the mouth of a hair dryer. Still other examples are the 1985 Andis U.S. Pat. No. 4,538,362, and the 2004 Langley U.S. Pat. No. 6,775,922 which teach a plurality of attachments, some of which include a comb. Though complex and lacking comb length adjustment, all these devices have in common the advantage of having hot air blowing between the comb's teeth.

The attachment of a comb to a fluid dispenser has the advantage of increasing the fluid's circulation. The two types are those which use a container and those that use a faucet, such as a garden hose.

Devices drawing fluid from a container, typically a deformable container or squeeze bottle, are intended for use with shampoo and other hair treatments. The 1938 Wallenius U.S. Pat. No. 2,108,184, 1970 Tesersek U.S. Pat. No. 3,520,311, 1989 Morgan U.S. Pat. Nos. 4,813,439 and 2001 Burrowes U.S. Pat. No. 6,302,607 are all examples of this type.

Devices drawing fluid from a faucet such as a garden hose are typically contemplated for use in applying large quantities of water to the hair. The 1977 Houston U.S. Design patent 244,712 is an example of a simple device of this kind, intended for use in washing a dog. The 1997 Frank U.S. Pat. No. 5,649,502 teaches a combed device intended for use in washing pets.

Though all the above liquid dispensing combs are effective, each features a comb of a specific length and lacks length adjustment.

All the tools in the above background are useful and have enjoyed some degree of commercial success though only the hair clipper kit is universally recognized by and available to consumers.

It would be advantageous for the other five tools in the background above to employ hair clipper attachment guide combs for the five advantages of the guide comb described, as well as for their consumer familiarity, lack of complexity, and the economy of scale which makes them extremely economical.

SUMMARY OF THE INVENTION

The diverse embodiments of the present invention all employ the same novel device: an object incorporating a dummy hair clipper head in order to allow the attachment of attachment guide combs to said object, whereby a new alternative use is created for the attachment guide combs through their attachment to said object.

What is meant by a dummy hair clipper head is a form (as in a structure) which conforms to at least those dimensions of a hair clipper's head (typically its stationary blade) which are necessary for its compatibility with attachment guide combs. This form, not itself being a functional blade, as is the stationary blade of a hair clipper, has the function of providing a means of attachment for attachment guide combs of the type intended for electric hair clippers. Similarly a mannequin, or dummy of a human, conforms to the dimensions necessary for clothing to fit it properly.

The first embodiment of the present invention is a means of organizing a set of attachment guide combs by attaching them to a series of connected dummy clipper heads which are attached to the lid of the box in which the clipper kit is stored.

The second embodiment is a conventional barber scissor fastened to a dummy clipper head to which the attachment guide combs can be attached. Once assembled, a scissor comb is created which is safe (the comb guarding the blade), and an effective means of trimming the hair to a uniform length with minimal noise or vibration.

The third embodiment is a razor comb having a razor held in a dummy clipper head with a handle. With the attachment of an attachment guide comb a razor comb is created.

The attachment guide combs typically have a V shaped groove as part of their attaching means. Both the dummy clipper heads for the razor comb and the scissor comb employ a novel method of engagement with the V shaped groove of the attachment guide comb which has several benefits and broader applications. Instead of engaging with the vertex of this groove they engage it along both the upper and lower portions so as not to extend fully into the groove.

The remaining embodiments include a conduit dummy blade which is hollow and open between the comb's teeth and attachable to a hose on top. This hose can then be attached to a vacuum's attachment hose, a hair dryer or faucet, whereby a vacuum comb, dryer comb, or liquid dispensing comb is created.

Essentially, the present invention functions as an adapter between existing devices and attachment guide combs, all of which benefit from economies of scale and are in most households already. The present invention lacks the complexity of the tools it effectively replaces and it is simple and inexpensive to manufacture. With the present invention the addition of a few pieces of plastic to a standard hair clipper kit transforms it from a single tool into a well organized tool kit with a plurality of uses.

BRIEF DESCRIPTION OF THE DRAWINGS

FIG. 1 shows the outer surface of a stationary blade of an electric hair clipper;

FIG. 2 shows the side of a hair clipper prior to its insertion into attachment guide comb;

FIG. 3 shows said hair clipper with its leading edge inserted into the attachment guide comb of FIG. 2;

FIG. 4 shows said hair clipper complete with guide comb attached and gripped in an operator's hand;

FIG. 5 shows the side of the hair clipper;

FIG. 6 shows the removed stationary blade of the hair clipper head of FIG. 5;

FIG. 7 another perspective view of the removed stationary blade of FIG. 5;

FIG. 8 is a perspective view of an attachment guide comb;

FIG. 9 is the attachment guide comb of FIG. 8 attached to the stationary blade of FIG. 7;

FIG. 10 is a perspective view of an attachment guide comb from above;

FIG. 11 is a side view of the attachment guide comb, a dotted line indicating the V shaped groove 66;

FIG. 12 is a perspective view of the attachment guide comb from below;

FIG. 13 is a perspective view of attachment guide comb from the rear;

FIG. 14 is a front view of an attachment guide comb;

FIG. 15 is a rear view of an attachment guide comb;

FIG. 16 is a top view of an attachment guide comb;

FIG. 17 is a bottom view of an attachment guide comb;

FIG. 18 is a side view of stationary blade 50 below a dummy blade 80 of the comb organizer 78 of the present invention;

FIG. 19 is a perspective view of the stationary blade 50 below a perspective view of the dummy blade 80 of the comb organizer 78 of the present invention;

FIG. 20 is a perspective view of the comb organizer 78 of the present invention with an attachment guide comb attached and a second guide comb of a smaller size unattached;

FIG. 21 is a perspective view of the comb organizer 78 from FIG. 20 as attached to the inside lid 86 of a partially shown box for a hair clipper kit 88, with a set of four attachment guide combs of different sizes attached to it;

DRAWINGS

Reference Numerals

| | | | |
|---|---|---|---|
| 50 | stationary blade | 52 | hair clipper |
| 54 | region of cutting teeth | 56 | central support region |
| 58 | reciprocating blade | 60 | rear region |
| 62 | two bolts | 64 | clipper guide comb |
| 66 | V shaped groove | 67 | teeth |
| 68 | groove abutments | 70 | comb's back |
| 72 | side abutments | 74 | latch |
| 76 | protrusions | 78 | comb organizer |
| 80 | dummy blade | 82 | thin rectangle |
| 84 | thick rectangle | 86 | lid |
| 88 | hair clipper kit box | 89 | spacer |
| 90 | scissor comb | 92 | barber's scissor |
| 94 | counter sunk hole | 96 | screw |
| 98 | dummy blade B | 100 | upper edge |
| 102 | lower edge | 104 | groove |
| 106 | razor comb | 108 | handle |
| 110 | top plate | 112 | razor blade |
| 114 | base plate | 116 | cylindrical protrusions |
| 118 | apertures | 119 | threaded post |
| 120 | conduit dummy blade | 121 | restricted flow conduit dummy blade |
| 122 | rear edge | 124 | lead edge |
| 126 | holes | 128 | conical pipe |
| 130 | conduit socket | 132 | upright bottle |
| 134 | liquid dispensing comb | 136 | hose |
| 138 | faucet | 140 | cylindrical adapter |
| 142 | attachment vacuum hose | 144 | larger cylindrical adapter |
| 146 | hair dryer | | |

DETAILED DESCRIPTION OF THE INVENTION

A precise understanding of a typical electric hair clipper and attachment guide comb and their compatibility is important to understanding the embodiments of the present invention. FIGS. 1-17 depict a typical hair clipper and attachment guide comb and do not represent the present invention.

Figure 1:
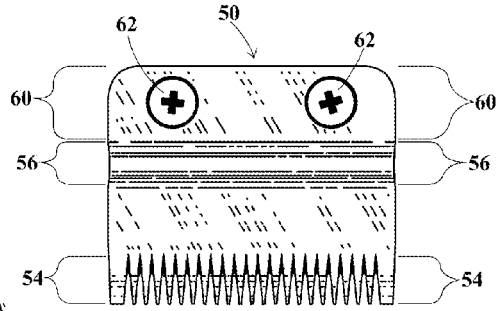
FIG 1 (PRIOR ART)
FIGS. 1-17 show prior art and do not represent the present invention.
Figure 5:
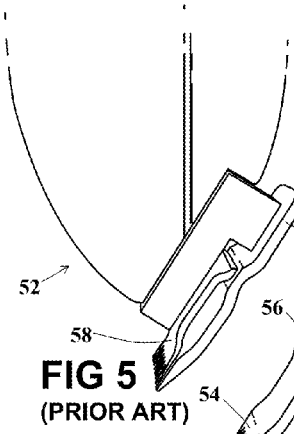
FIG 5 (PRIOR ART)
Figure 6:
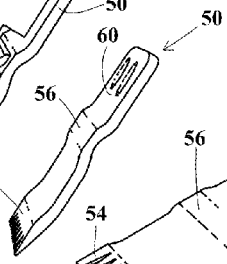
FIG 6 (PRIOR ART)
Figure 7:
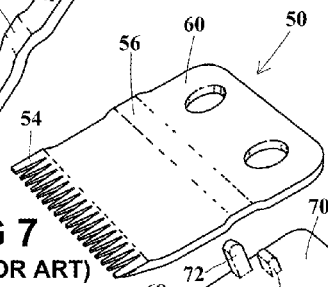
FIG 7 (PRIOR ART)
Figure 8:
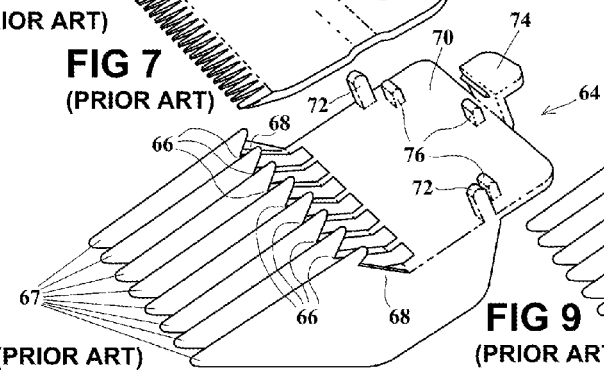
FIG 8 (PRIOR ART)

Referring to FIGS. 1, 5, 6, and 7 the stationary blade 50 of the hair clipper 52 is shown. FIG. 1 shows the outer surface of the stationary blade 50 which is entirely visible when attached to the hair clipper 52. FIG. 5 shows the stationary blade 50 as attached to the hair clipper 52 and FIGS. 6 and 7 show the stationary blade 50 removed from the clipper 52 with the inner surface shown.

The stationary blade 50 is 1.8 inches wide and 1.5 inches from front to back.

The region of cutting teeth 54 at the front of the blade and a central support region 56 both curve toward the inner side of the blade. They are ground flat resulting in two raised flat plateaus 0.025 inches above the remainder of the stationary blade.

It is with these two raised regions that the reciprocating blade 58 is in contact, as shown in FIG. 5.

The rear region 60 is flat and extends to 0.5 inches from the rear edge of the stationary blade 50, at which point the central support region 56 begins to curve toward the inner side. It is by this rear region 60 that the blade 50 is secured to the hair clipper 52 by two bolts 62.

The stationary blade 50 is made from 0.075 inch thick steel, making for a blade 50 with an over all thickness of 0.1 inches from the top of the raised regions 54 and 56 to the bottom, outer surface, of rear region 60. The leading edge along the region of cutting teeth 54 is tapered to 0.025 inches and consists of a series of teeth with flat tips.

Referring to FIGS. 8-17 the attachment guide comb 64 and its means of attachment to the blade 50 is now described. The attachment guide comb is secured to the blade 50 by contact with its four edges and the outer surface of the rear region 60 as follows.

Once attached, the attachment guide comb 64 is secured to the stationary blade 50 along its leading edge, the tapered edge of the region of cutting teeth 54, by a V shaped groove 66 in the series of comb teeth 67. The teeth 67 line up with the flat tips of the teeth which make up the leading edge along the region of cutting teeth 54.

The V shaped groove 66 terminates on each end in the groove abutments 68 which rise up to prevent the blade 50 from moving from side to side. The distance between the inside surfaces of the groove abutments 68 is 1.8 inches, corresponding to the width of the blade 50. The V shaped groove's position within the comb can be better understood by referring to FIG. 11 where a dotted line indicates the location of the V shaped Groove 66 in relation to the groove abutments 68. The V shaped groove 66 holds the tapered leading edge of the blade 50 with the upper surface of its raised region of cutting teeth 54 at 0.2 inches above the level of the comb's back 70.

At a distance of 0.5 inches from the rear edge of the comb back 70, two side abutments 72 abut the side edges of the blade 50. The distance between the side abutments 72 is also 1.8 inches corresponding to the width of the blade 50 and they prevent movement from side to side.

The rear edge of the blade 50 is secured by a latch 74. The distance between the latch 74 and the groove 66 is 1.5 inches corresponding to the length of blade 50 and preventing movement forward or backward.

A series of three protrusions 76 rise 0.1 inches and are located within the rear 0.5 inches of the comb back 70. The protrusions 76 abut the outer surface of the blade 50 along the flat rear region 60. In combination with the V shaped groove 66 and latch 74 these protrusions hold the comb's back 70 parallel to and 0.1 inches from the outer surface of the rear region 60 and 0.2 inches from the level of the upper surface of the region cutting teeth 54.

Figure 9:
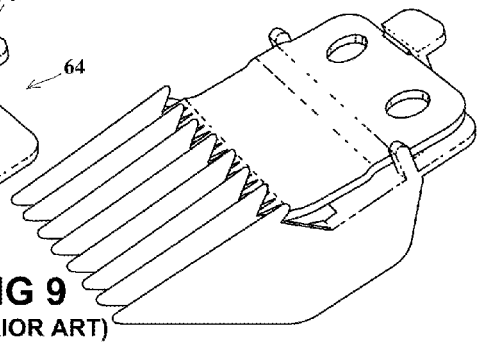
FIG 9 (PRIOR ART)
Figure 10:
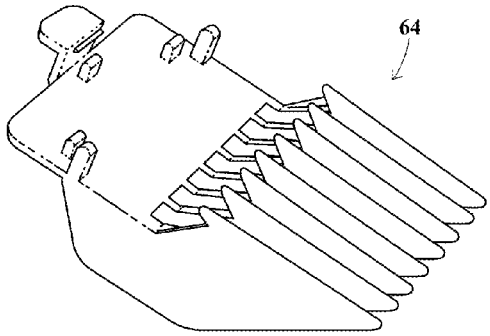
FIG 10 (PRIOR ART)
Figure 11:
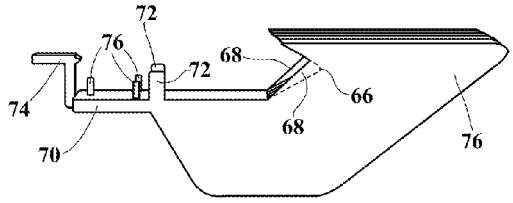
FIG 11 (PRIOR ART)
Figure 12:
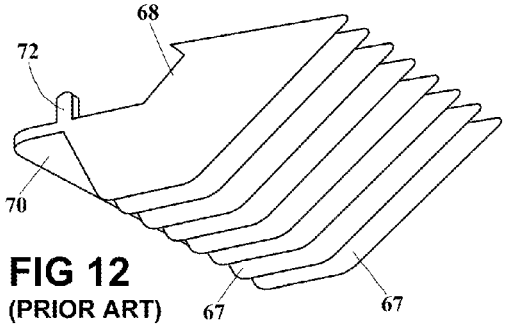
FIG 12 (PRIOR ART)
Figure 13:
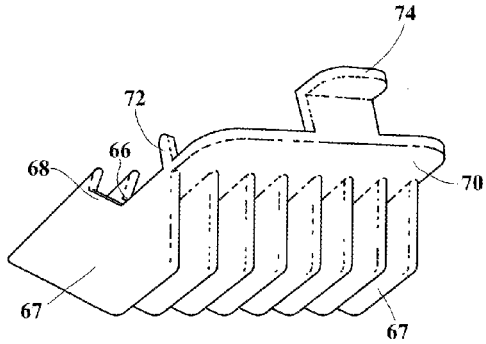
FIG 13 (PRIOR ART)
Figure 14:
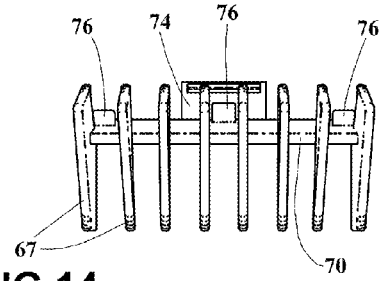
FIG 14 (PRIOR ART)
Figure 15:
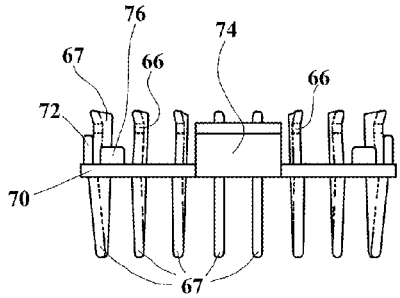
FIG 15 (PRIOR ART)
Figure 16:
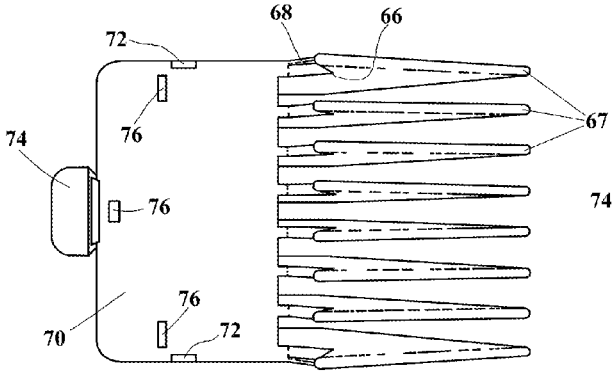
FIG 16 (PRIOR ART)
Figure 17:
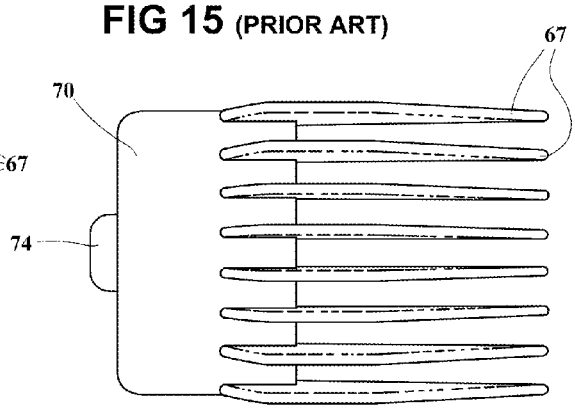
FIG 17 (PRIOR ART)

It is in this way that the attachment guide comb 64 is secured to the blade 50 as shown in FIG. 9. The areas of contact being the V shaped groove 66 along the leading edge, the groove abutments 68 and side abutments 72 along the sides, the latch 74 along the rear edge, and the protrusions 76 contacting the rear region 60. FIG. 9 shows the stationary blade 50 removed from the hair clipper 52 to allow the method of attachment to be more clearly visible. The stationary blade 50 is not normally removed from the hair clipper 52.

Figure 2:
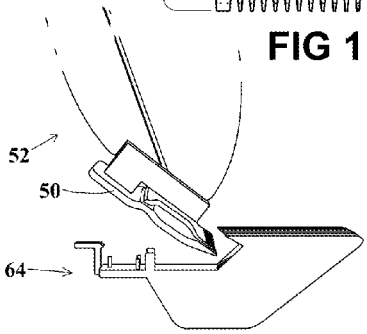
FIG 2 (PRIOR ART)
Figure 3:
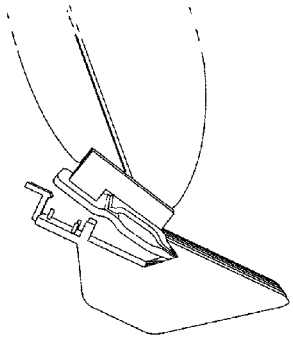
FIG 3 (PRIOR ART)
Figure 4:
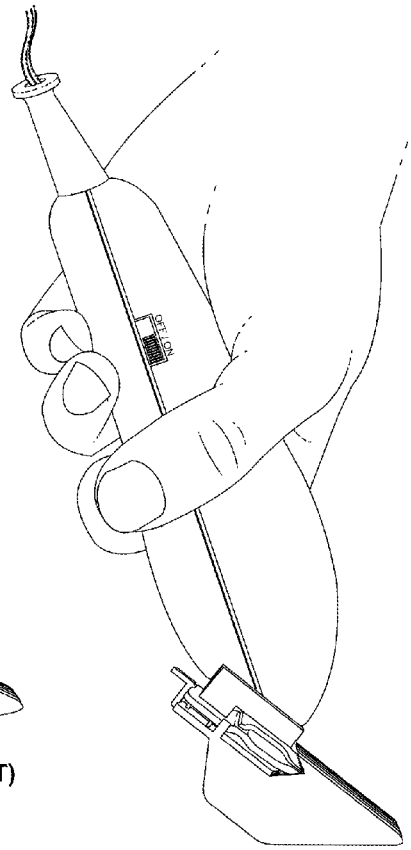
FIG 4 (PRIOR ART)

The procedure for the attachment of the comb 64 to the hair clipper 52 is shown in FIGS. 2-4. The leading edge is placed in the V shaped groove 66 of the attachment guide comb 64 as shown in FIG. 3 and the comb is rotated into place where the latch 74 secures the comb at the rear edge of the blade 50. FIG. 4 shows hair clipper 52 with the attachment guide comb 64 attached as it would be used by the operator in cutting along a horizontal surface. To remove the comb 64, the latch 74 is pulled back and the attachment guide comb 64 is rotated away from the blade 50 and the leading edge of the blade 50 is removed from the V shaped groove 66.

In use, as shown in FIG. 4, the comb's teeth 67 which are flexible to some degree (the attachment guide comb 64 is typically made of plastic) are supported by the comb back 70 and their engagement with the teeth of the stationary blade 50 along its leading edge at their points of contact at the vertex of the V shaped groove 66. In use it is common for one or more of the teeth 67 to slip off the metal teeth of the blade 50 with which they are making contact at the vertex of the V shaped groove 66 and to lose this support, bending to one side. This is because the teeth along the leading edge of the stationary blade 50 can only provide the series of narrow flat tips of its teeth for support with the series of gaps between them.

FIGS. 10-17 show the attachment guide comb 64 from all angles, depicting just one attachment guide comb size of the many sizes available in a kit. In use, as shown in FIG. 4, the comb back 70 is above and behind the V shaped groove 66 and the leading edge of the blade 50. The comb back 70 is 1 inch from its rear edge to its leading edge leaving 0.5 inches open between its leading edge and the vertex of the V shaped groove 66. This open area, most clearly shown in FIGS. 10 and 16, will be used by several embodiments of the present invention to be described later.

There are eight teeth 67 which rest on their longest side when in use as shown in FIG. 4. They hold the comb's back 70 and blade 50 at a thirty degree angle with the surface. Refer to the background of the invention for a list of the five advantages of the attachment guide comb 64 over a traditional flat comb.

The first embodiment of the invention is a comb organizer 78 and is shown in FIGS. 20 and 21. The organizer 78 consists of four adjacent dummy blades 80 shown separately in FIGS. 18 and 19.

FIGS. 18 and 19 show the dummy blade 80 above the stationary blade 50 to which it partially conforms. The dummy blade 80 includes a thin rectangle 82 which is 0.025 inches thick, and 1.8 inches by 0.75 inches, overlapping and bonded to a thick rectangle 84 which is 0.075 inches thick, and 1.8 inches by 1.2 inches. The rectangles overlap by 0.45 inches resulting in a combined rectangle 1.8 inches by 1.5 inches, which conforms to those dimensions of the blade 50.

The thin leading edge is 0.025 inches higher than the thick rear edge which also conforms to those dimensions of the stationary blade 50. The underside of the thick rectangle 84 is flat for more than 0.5 inches from the rear edge providing a suitable surface for the abutments 76, just as the rear region 60 does of the stationary blade 50 as described earlier.

With these dimensions the dummy blade 80, made of a suitably rigid material, would be compatible with the attachment guide comb 64. Additionally the leading edge of the dummy blade 80, being continuous, makes a superior engagement with the V shaped groove 66 to that made by the stationary blade 50, as it obviates the possibility of the teeth 67 slipping and losing support as described above.

FIGS. 20 and 21 show the first embodiment of the present invention, the comb organizer 78, which includes four dummy blades 80 spaced 0.5 inches apart and connected by bridges 82 which connect the sides of the dummy blades 80 together. The bridges 82, which are the interconnection between the dummy hair clipper heads, are 0.4 inches wide and extend from the rear edge of the thin rectangle 82 to 0.35 inches from the its leading edge. The bridge 82 does not interfere with the attachment of the attachment guide comb 64 as the attachment guide comb 64 is open along the sides between the groove abutments 68 and the side abutments 72.

FIG. 20 shows the attachment guide comb 64 attached to one of the dummy blades 80. A second, smaller comb 84 which is not attached is also shown.

FIG. 21 shows four guide combs of different sizes attached to said comb organizer 78 which is attached to the lid 86 of a hair clipper kit box 88. The comb organizer 78 is attached to a spacer 89 which is in line with the bridges 82 and which holds the comb organizer 78 at 0.5 inches away from the lid. This is necessary so that the combs can be attached as the teeth 67 with the V shaped groove 66 extend around the leading edge of the blade, as does the latch 74 around the rear edge.

The comb organizer 78 could most easily be made in one piece integral with the lid of the box and its description here in parts is for clarity and to allow a precise understanding of the dimensions. Attached to the lid 86 of the clipper kit box 88, said organizer would provide a means of storing and organizing combs as quick and effective as their attachment to the stationary blade 50.

FIGS. 22-26 show the second embodiment of the invention which is the scissor comb 90. The scissor comb 90 includes a barber's scissor 92 with a single counter-sunk hole 94 drilled into one blade 1.5 inches from the tip. A screw 96 secures the scissor 92 to a dummy blade B 98. The dummy blade B 98 allows the attachment of the attachment guide comb 64. The scissor comb 90 can then be pulled through hair and employed cutting the hair to a uniform thickness.

Figure 22:
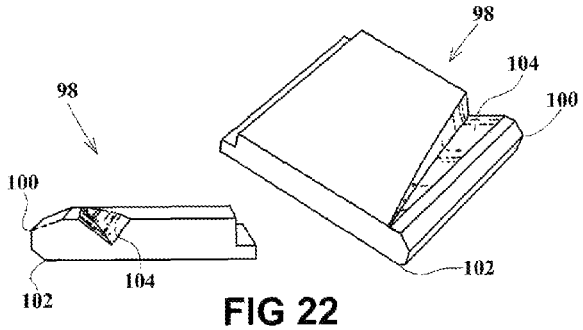
FIG. 22 is a side and perspective view of the dummy blade B 98 of the scissor comb 90 of the present invention.
Figure 23:
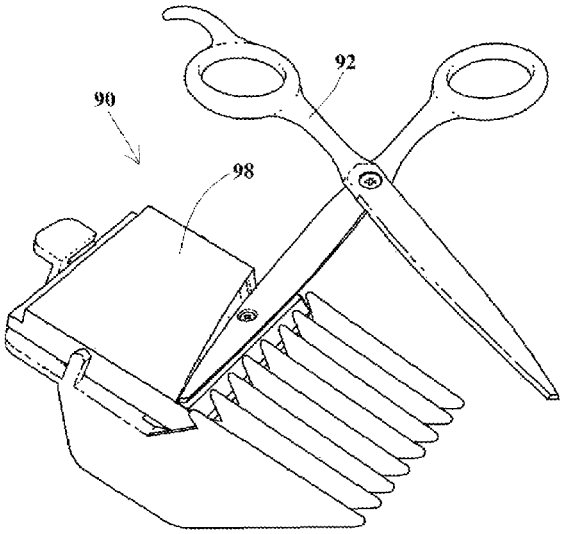
FIG. 23 is a perspective view of the scissor comb 90 of the present invention fully assembled with scissor and attachment guide comb attached.
Figure 24:
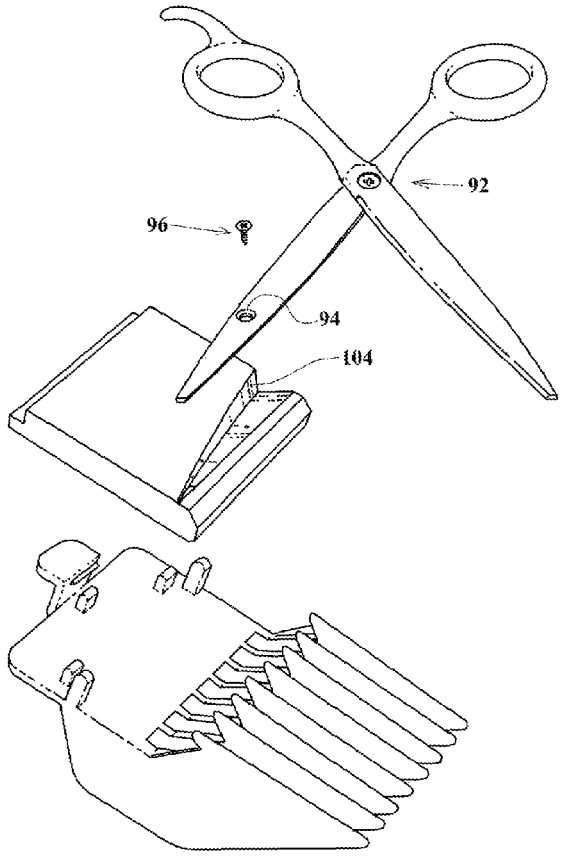
FIG. 24 is an exploded perspective view of FIG. 23.

The dummy blade B 98 is shown from two angles in FIG. 22, from the side and in perspective. It is 1.8 inches wide, as is the stationary blade 50. It is 1.4 inches from its beveled leading edge to its rear edge, where the real stationary blade 50 is 1.5 inches. This shorter length is due to the novel means by which dummy blade B 98 engages the V shaped groove 66 which is indicated by dotted lines in FIG. 25. Rather than contacting the groove 66 at its vertex, as the stationary blade 50 does, it instead makes dual contact, an upper contact along its upper edge 100 with the upper portion of the groove and a lower contact along its lower edge 102 with the lower portion as shown. As both these edges are continuous, this makes a superior engagement with the V shaped groove 66 to that made by the real stationary blade 50, as it obviates the possibility of the teeth 67 slipping and losing support as described above.

In the case of the scissor comb 92, the primary reason dummy blade B 98 contacts the V shaped groove at edges 100 and 102 is precisely so that it can be shorter than the blade 50 and not extend as far forward into the V shaped groove 66. This is because it is important that the cutting blade of the scissor 92 be positioned ahead of the dummy blade B 98 as in the form shown said dummy blade B 98 represents an obstruction to the flow of hair. This novel means of dual engagement of the V shaped groove 66 is part of the razor comb of the present invention as well and has broad applications.

The dummy blade B 98 could alternatively engage the vertex of the V shaped groove with a leading edge consisting of a series of long teeth, as the stationary blade 50 does though with much longer teeth (this alternate form is considered obvious within the present invention and is not shown).

The dummy blade B 98 is 0.25 inches thick. The rear edge is reduced to 0.075 inches as shown, to be compatible with the comb's latch 74.

Figure 25:
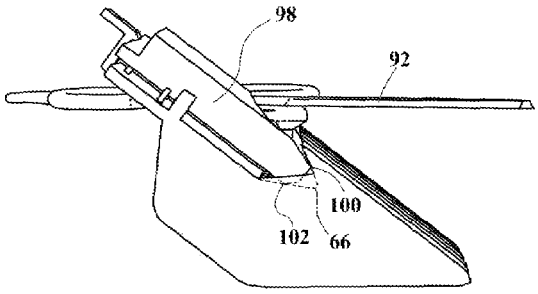
FIG. 25 is a side view of FIG. 23 with dotted lines indicating the contact of the dummy blade B 98 with the V shaped groove 66.
Figure 26:
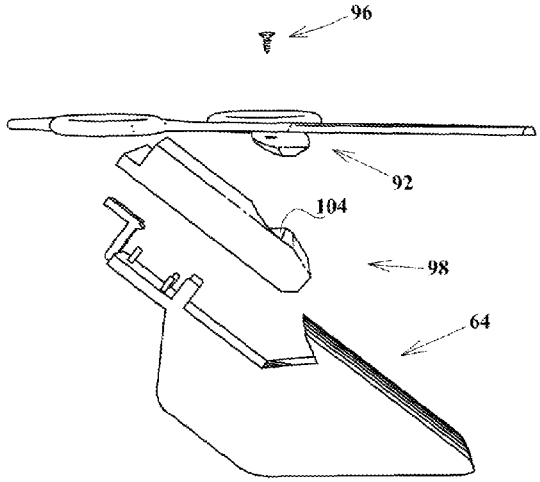
FIG. 26 is an exploded view of FIG. 25.
Figure 27:
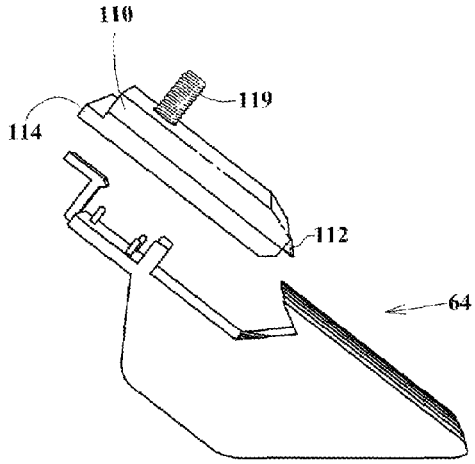
FIG. 27 is the razor comb 106 of the present invention without a handle and above the guide comb.

A groove 104 is carved into the upper surface of dummy blade B 98 at a 30 degree angle. In use the attachment guide comb 64 hold the comb's back 70 and blade 50 at a 30 degree angle with the surface. This groove 104 is carved at 30 degrees so that the scissor 92 will be parallel to the surface. The groove 104 is also suitably above the upper edge 100 so that when attached the scissor 92 will have its cutting edge above the tops of the comb's teeth 67, as shown in FIG. 25.

The groove 104 is carved in a curve congruent to the back edge of the blade of the scissor 92. Once secured by the screw 96 the blade of the scissor 92 will be firmly connected to and held in place against the dummy head B 98.

Once assembled, the scissor comb 90 could be pulled through the hair and a series of cuts made with the scissor to achieve an overall cut of uniform length. Additionally, the attachment guide comb 64 and dummy head B 98 would effectively guard the blade and make the scissor comb 90 much safer to use than a scissor alone.

Figure 28:
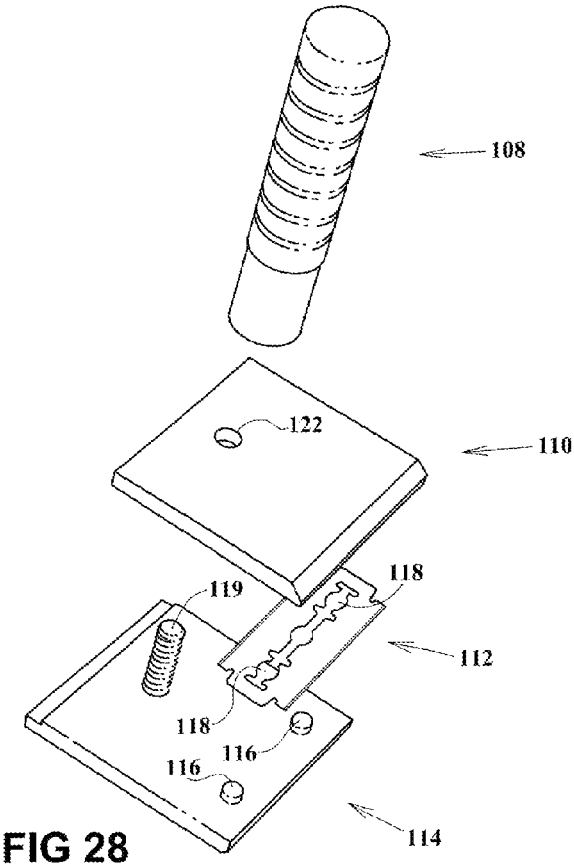
FIG. 28 is an exploded perspective view of the razor comb 106 of the present invention without a guide comb.
Figure 29:
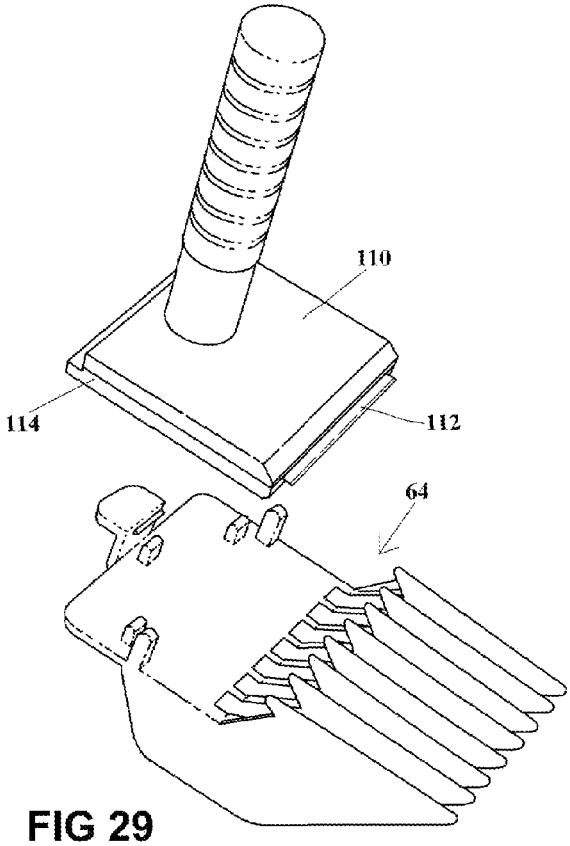
FIG. 29 is a perspective view of FIG. 28 fully assembled above an attachment guide comb.
Figure 30:
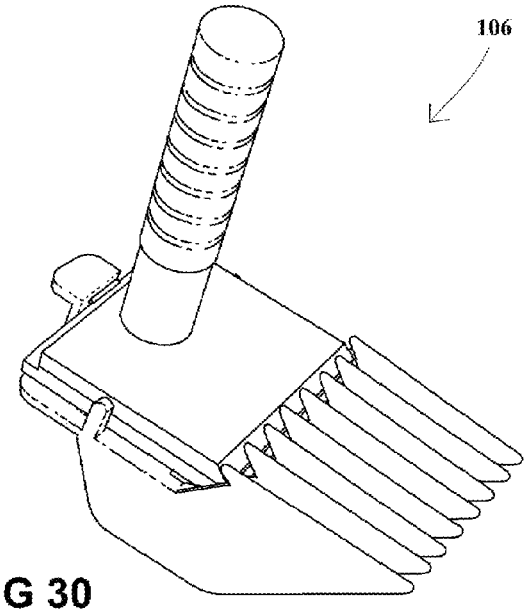
FIG. 30 shows FIG. 29 fully assembled, being the razor comb 106.
Figure 31:
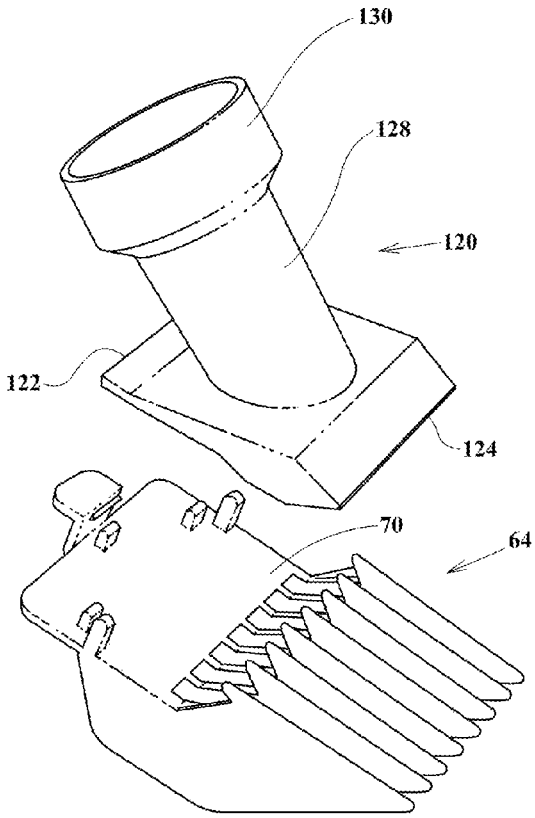
FIG. 31 is a perspective view of the conduit dummy blade 120 of the present invention above the attachment guide comb 64.
Figure 32:
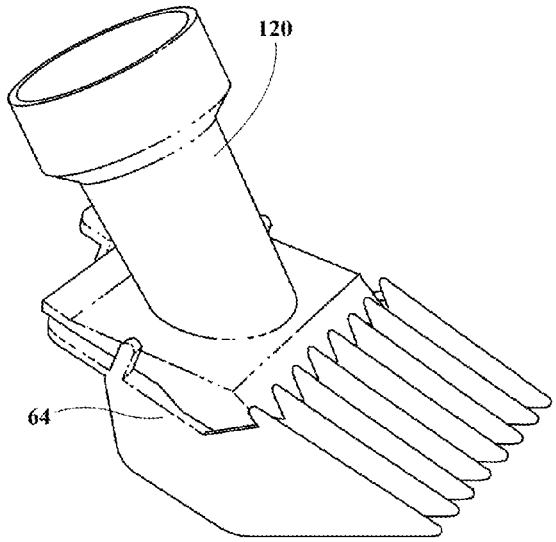
FIG. 32 is a perspective view of the attachment guide comb 64 attached to the conduit dummy blade 120 of FIG. 31.

The third embodiment of the present invention, the razor comb 106 is shown in FIGS. 27-30. Referring to FIG. 28 which is an exploded view of the four pieces of the razor comb 106 (other than the attachment guide comb 64), the razor comb 106 consists of a handle 108, a top plate 110, a razor blade 112, and a base plate 114 which when fully assembled connect with the attachment guide comb 64.

The razor 112 is held in position on the base plate 114 by two cylindrical protrusions 116 which are inserted into apertures 118 of said razor 112. The top plate 110 is then placed over the base plate 114 passing the threaded post 119 of the base plate 114 through the hole 122 of the top plate 110 and finally inserting the cylindrical protrusions 116 into corresponding cylindrical depressions (not shown) in the underside of the top plate 110. The handle 108, which has a threaded socket (not shown), is then threaded onto the post 119 and the four pieces are thereby secured together.

The top plate 110 and base plate 114 together constitute a dummy blade with dimensions identical to dummy blade B 98 with the exception of the presence of the threaded post 120 and the omission of the groove 104. The dummy blade of plates 110 and 114 engages the V shaped groove 66 in the same novel fashion as dummy blade B 98 (refer to FIG. 25). The purpose of doing so in this embodiment is to leave the remainder of the V shaped groove 66 open for the operative member, which is the razor blade 112, to occupy. As stated above, this novel engagement is superior to the engagement made by the real stationary blade 50 as the teeth 67 are in contact with a continuous surface. It should also be noted that this engagement is superior as it places the cutting edge ahead of the engaging structure so that the cutting edge is more fully exposed.

While the scissor comb 90 cuts entirely above the V shaped groove 66, the razor blade 112 of the razor comb 106 is near the vertex of the V shaped groove 66, in approximately the same location the cutting teeth of the clipper 52 would be.

As stated with the scissor comb 90 an alternate form (considered obvious within the present invention and lacking several advantages stated above) for the dummy clipper head of the razor comb 106 would be long teeth which would engage the vertex of the V shaped groove 66 as the blade 50 does, leaving the razor 112 exposed between said teeth (as the Custer U.S. Pat. No. 4,663,841 does).

Once assembled, the razor comb 106 could be pulled through the hair and the razor 112 would be both effectively guarded and the length of hair cut reliably, regulated by the attachment guide comb 64.

The remaining embodiments of the present invention all involve the use of a conduit dummy blade 120, shown in FIGS. 31-36. The conduit dummy blade 120 is designed to allow the use of a guide comb with a fluent material flowing through the opening between the teeth 67. This opening is as wide as the attachment guide comb 64 and begins at the leading edge of the comb back 70 up through the V shaped groove 66, as described earlier and is most clearly shown in FIGS. 10 and 16.

The conduit dummy blade 120 is hollow with a length from the rear edge 122 to its leading edge 124 of 1.5 inches and a width of 1.8 inches. The leading edge 124 is 0.025 inches above the plane of the upper surface of the rear edge 122. The dummy rear edge 122 is 0.075 inches thick for compatibility with the latch 74 and the under side is flat for more than 0.5 inches from the dummy rear edge 122 providing a suitable surface for abutment by the protrusions 76. With these dimensions the conduit dummy blade 120 corresponds to the stationary blade 50 and is compatible with the attachment guide comb 64. Additionally, as the leading edge 124 is continuous, a superior engagement with the V shaped groove 66 is made to the engagement made by the stationary blade 50 for the reasons discussed previously.

The front of the dummy conduit blade 120 is wedge shaped as shown in FIGS. 31-36, and with the leading edge 124 in contact with the vertex of the V shaped groove 66 this wedge fills said groove.

Referring to FIGS. 31-36 the underside of the conduit dummy blade 120 is parallel to and 0.1 inches from the comb back 70, from the rear edge 122 to 0.7 inches from the rear edge 122. The underside of the dummy conduit blade 120 then slopes down toward the comb back to converge with the comb back 70 at its leading edge, where the opening between the teeth 67 begins. The side walls of the conduit dummy blade 120 continue with their lower edges flush with the outermost teeth 67 until the leading edge is formed as described above. The opening located along the underside of said conduit dummy blade is thereby focused down through the openings between the teeth 67 and not out the sides or back of the attachment guide comb 64.

Figure 33:
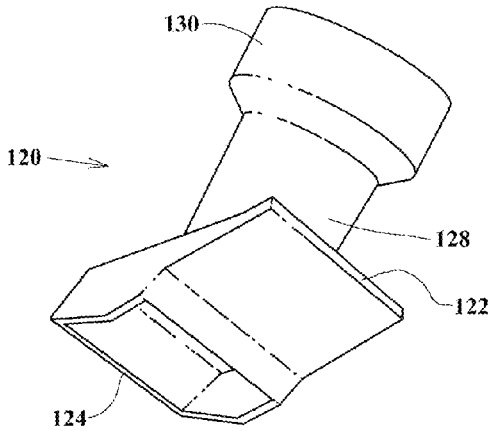
FIG. 33 is a perspective view from the rear and below of the conduit dummy blade 120 of the present invention.
Figure 34:
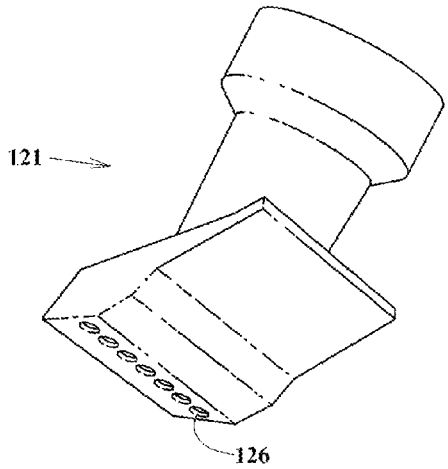
FIG. 34 is a perspective view from the rear and below of the restricted flow conduit dummy blade 121 of the present invention.

FIG. 33 shows that the conduit dummy blade 120 is open on the underside from where it would meet the leading edge of the comb back 70 on up to the leading edge 124. FIG. 34 shows that the restricted conduit dummy blade 121 is closed except for 7 holes 126 along the lower incline of the wedge, which align with the lower portion of the V shaped groove 66 and the spaces between the eight teeth 67.

The upper surface of the conduit dummy blade 120 slopes up from near the rear edge 122 until it meets the wedge of the front of dummy conduit blade 120. Out of this inclined surface on the upper side of the conduit dummy blade 120 conical pipe 128 rises and expands to suitably terminate in conduit socket 130 threaded to accommodate a standard 1 inch lip of a plastic bottle or garden hose.

Figure 35:
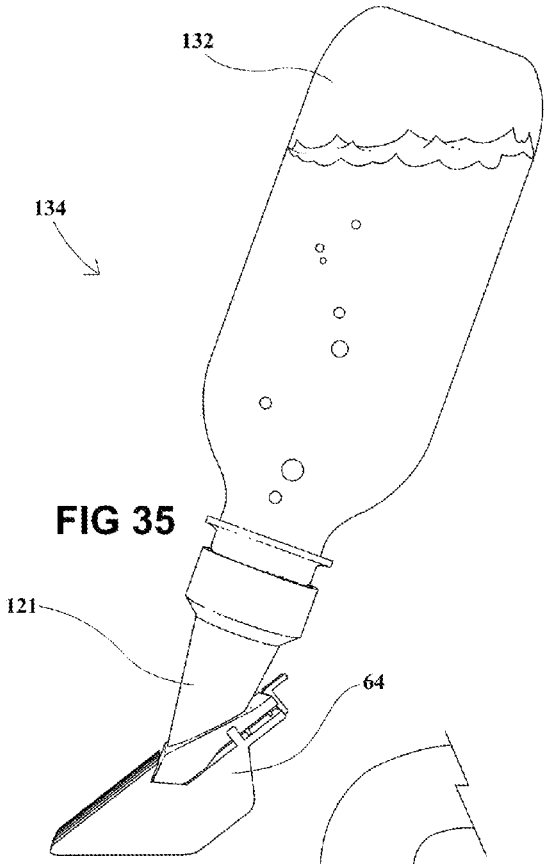
FIG. 35 is a side view of the liquid dispensing comb 134 of the present invention fully assembled with a bottle containing liquid attached.

The fourth embodiment of the present invention is the connection of a plastic bottle 132 to the restricted flow conduit dummy blade 121 as shown in FIG. 35 to create the liquid dispensing comb 134. The restricted conduit dummy blade 121 is screwed onto an upright bottle 132 filled with fluid. The attachment guide comb 64 is then attached and the three items together constitute a liquid dispensing comb 134. Once inverted the liquid flows through the hollow restricted conduit blade 121 and out the holes 126 and between the teeth 67 and onto the hair being combed through. In this way shampoo and other hair treatments can be applied to hair as it is simultaneously being combed.

Figure 37:
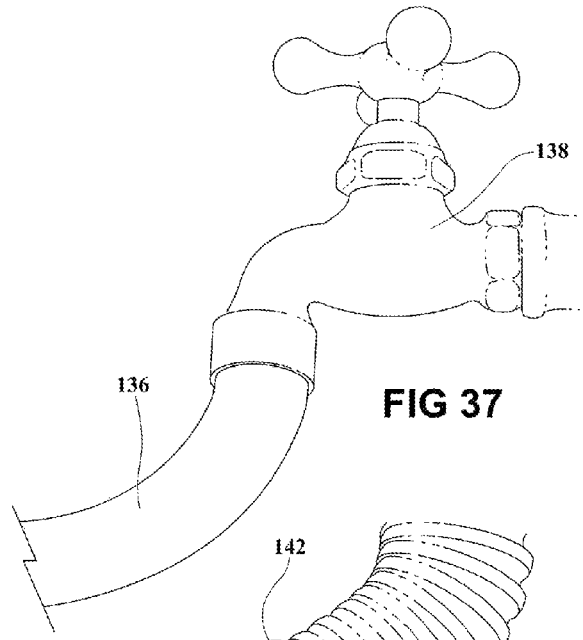
FIG. 37 shows the faucet end of the liquid dispensing comb of the present invention with a hose attached to a faucet.
Figure 36:
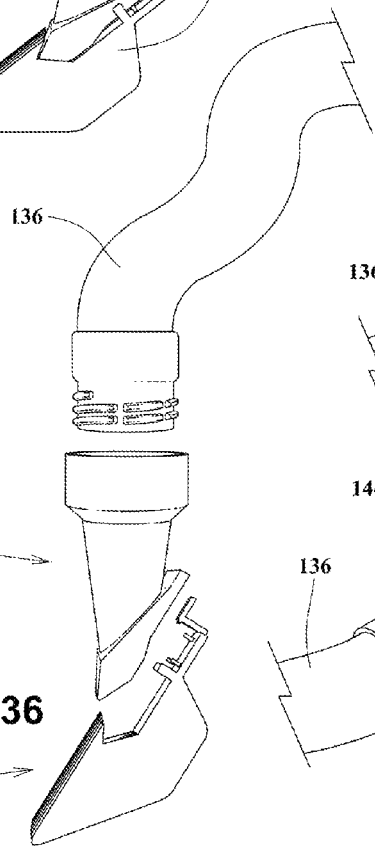
FIG. 36 is an exploded perspective side view of the vacuum comb, the dryer comb and the liquid dispensing comb of the present invention from the attachment guide comb end of the hose.
Figure 38:
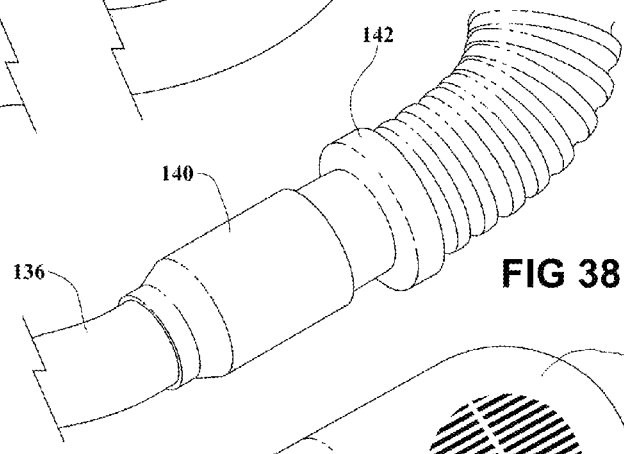
FIG. 38 shows the vacuum end of the hose for the vacuum comb of the present invention with the hose 136 attached to an attachment vacuum hose 142.
Figure 39:
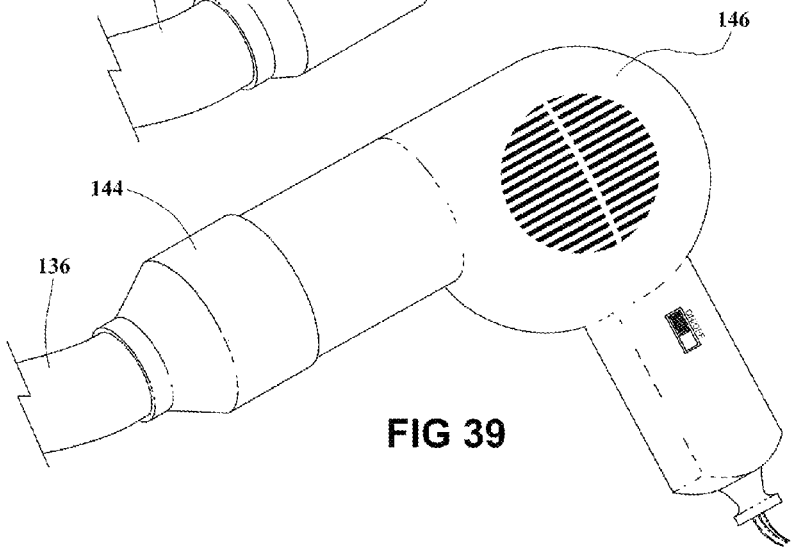
FIG. 39 is the dryer end of the hose 136 for the dryer comb of the present invention with a hose 136 attached to a hair dryer 146.

Referring to FIGS. 34, 36 and 37 the second variation on the fourth embodiment of the present invention is the connection of a hose 136 to the restricted conduit dummy blade 121, the other end of the hose being attached to a faucet 138. In this way water would flow out the holes 126 as described above. Use of pressurized water would be effective as well as the comb would not be knocked off by the pressure since the holes 126 are aligned with the openings between the teeth 67.

The fifth embodiment of the present invention involves connecting a vacuum source to create a vacuum comb. Conduit Dummy blade 120 with its large opening would have an attachment guide comb 64 connected to it and a hose 136 connected as described above. The other end of the hose 136 would connect to a cylindrical adapter 140 with an inside diameter appropriate for connection with the attachment vacuum hose 142 of a household vacuum. In this way, once connected the vacuum comb could be combed through the hair as the vacuum removed dislodged debris.

The sixth embodiment of the present invention is a third application of the conduit dummy blade 120, the dryer comb. The device is assembled as described above with the exception that the cylindrical adapter 140 would be replaced by a larger cylindrical adapter 144 suitable for connection to the barrel of a hair dryer 146. In this way, once connected a dryer comb could be combed through the hair as hot air blew between the teeth 67.

The creation of the five tools and the organizer described here are all illustrative examples of the application of a dummy clipper head in creating new uses for guide combs. It should be clear from this description that there is no limit to the number of devices that could be created with the present invention, just as there is no limit to the number of devices which could include a comb.

Only a few of the many forms that the dummy clipper head could take are shown here. These forms have been selected for the clarity with which they illustrate the nature of the present invention. It is likely that if mass produced their form would change though they would still represent the principle of the present invention.

Like the elongated teeth on a dummy head mentioned in the description of the scissor comb 90 and the razor comb 106, there are many variations which are within the scope of the present invention.

The precise dimensions given for both the stationary blade 50 and the attachment guide comb 64 and their means of engagement are to illustrate a typical example. Variations in these dimensions and the method of attachment should be construed as being within the scope of this patent.

The novel dual engagement of the V shaped groove 66 which is part of the scissor comb 90 and razor comb 106 should not be construed as being limited to these two devices. This novel method of connection to a guide comb has broad application to both the dummy hair clipper heads of the present invention as well as to the hair clipper itself.

None of the specifics of the detailed description above should be construed as limiting the scope of the invention. They are in fact not necessarily the preferred embodiments (as mentioned the guide comb organizer would be most practically produced as a single integral piece and was describe in parts for the sake of clarity).

Thus the scope of the invention should be determined by the following claims and their legal equivalents, rather than by the examples given.

I claim:

1. A scissor comb comprising:

(a) at least one attachment guide comb comprising a comb back and a plurality of flat teeth, said flat teeth being connected to said comb back, wherein said flat teeth define a V-shaped groove and said comb back has a plurality of abutments;

(b) a pair of scissors having a first blade and a second blade, said first blade comprising a flat inner surface and a sharpened edge;

(c) a rigid form for connecting said attachment guide comb to one of said blades, said rigid form having a leading edge configured to position in said V-shaped groove and said rigid form having a plurality of surfaces configured to engage with said plurality of abutments, said rigid form being configured to dispose said first blade and said second blade above said V-shaped groove, and to dispose said flat teeth below said sharpened edge;

(d) said rigid form being connected to said first blade by a connection means; and (e) said attachment guide comb being removably attached to said rigid form by said V-shaped groove and said plurality of abutments, whereby said scissor comb allows for the simultaneous and combined employment of said pair of scissors with said attachment guide comb.

2. The scissor comb of claim 1 wherein the attachment guide comb, once it is attached to the rigid form, is disposed at an angle.

3. The scissor comb of claim 2 wherein the angle is thirty degrees.

4. The scissor comb of claim 1 wherein said rigid form and said first blade are composed of a single piece of material.

5. The scissor comb of claim 1 wherein said connection means comprises at least one screw.

6. The scissor comb of claim 1 wherein said leading edge is continuous.

7. A scissor comb grooming device comprising:

at least one attachment guide comb comprising a planar comb back, a plurality of planar teeth, said planar teeth each having a V-shaped notch, said planar teeth being perpendicularly attached to said planar comb back, said planar teeth being arranged in a row comprising a plurality of inner teeth and two outermost teeth, said V-shaped notches being aligned parallel to said planar comb back forming a V-shaped groove, a plurality of abutments comprising at least two abutments with abutting surfaces perpendicular to said V-shaped groove at said outermost teeth;

a pair of scissors comprising a first blade and a second blade each having a dull outer edge, a sharpened inner edge, an outer side and a planar inner side, said first blade being pivotably connected to said second blade, said first blade and said second blade being free to pivot in a cutting action causing said first blade's planar inner side to come into contact with said second blade's planar inner side;

a rigid form comprising a leading edge and a plurality of surfaces configured to engage with said attachment guide comb and said pair of scissors, said rigid form being connected to said first blade's outer side and said attachment guide comb, wherein said second blade freely pivots into contact with said first blade, and said first blade is disposed above said V-shaped groove with said planar teeth extending beneath said first blade's sharpened inner edge, and said leading edge is substantially parallel to the sharpened inner edge of said first blade and is disposed in said V-shaped groove; and said attachment guide comb being releasably attached to said rigid form.

8. The scissor comb of claim 7 wherein the attachment guide comb, once it is attached to the rigid form, is disposed at an angle.

9. The scissor comb of claim 8 wherein the angle is thirty degrees.

10. The scissor comb of claim 8 wherein said V-shaped groove comprises an upper surface, a lower surface and a vertex, said leading edge comprises an upper edge and a lower edge, said leading edge engaging said V-shaped groove without contacting said vertex and with said upper edge contacting said upper surface and said lower edge contacting said lower surface.

11. The scissor comb of claim 8 wherein said leading edge is continuous.

12. The scissor comb of claim 8 wherein said leading edge comprises a plurality of teeth.

13. The scissor comb of claim 7 wherein said form and said first blade are composed of a single piece of material.

14. The scissor comb of claim 7 wherein said form is connected to said first blade by a connection means which allows said form to be removed from said first blade.

15. The scissor comb of claim 14 wherein said connection means is at least one screw.

* * * * *